US011225694B2

(12) United States Patent
Ly et al.

(10) Patent No.: US 11,225,694 B2
(45) Date of Patent: Jan. 18, 2022

(54) COOLING PANEL FOR METALLURGICAL FURNACE

(71) Applicant: PAUL WURTH S.A., Luxembourg (LU)

(72) Inventors: Giang Kien Ly, Luxembourg (LU); Nicolas Maggioli, Thionville (FR)

(73) Assignee: PAUL WURTH S.A., Luxembourg (LU)

( * ) Notice: Subject to any disclaimer, the term of this patent is extended or adjusted under 35 U.S.C. 154(b) by 179 days.

(21) Appl. No.: 16/487,987

(22) PCT Filed: Feb. 21, 2018

(86) PCT No.: PCT/EP2018/054285

§ 371 (c)(1),
(2) Date: Aug. 22, 2019

(87) PCT Pub. No.: WO2018/153920

PCT Pub. Date: Aug. 30, 2018

(65) Prior Publication Data

US 2020/0024678 A1 Jan. 23, 2020

(30) Foreign Application Priority Data

Feb. 22, 2017 (LU) ..... 100107

(51) Int. Cl.
*C21B 7/10* (2006.01)
*F27B 1/24* (2006.01)
(Continued)

(52) U.S. Cl.
CPC ..... *C21B 7/106* (2013.01); *F27B 1/24* (2013.01); *F27D 1/12* (2013.01);
(Continued)

(58) Field of Classification Search
CPC ... C21B 7/106; C21B 7/10; F27B 1/24; F27D 1/12
(Continued)

(56) References Cited

U.S. PATENT DOCUMENTS 5,904,893 A * 5/1999 Stein ..... C21B 7/10 266/46
7,537,724 B2 * 5/2009 Stastny ..... C21B 7/10 266/193
(Continued)

FOREIGN PATENT DOCUMENTS

CN 102047060 A 5/2011
JP 2015187288 A 10/2015
(Continued)

OTHER PUBLICATIONS

International Search Report dated Apr. 9, 2018 re: Application No. PCT/EP2018/054285, pp. 1-3, citing: WO 2010/076368 A1, W 03/067154 A1 and WO 2015/144985 A1.
(Continued)

*Primary Examiner* — Jessee R Roe
*Assistant Examiner* — Michael Aboagye
(74) *Attorney, Agent, or Firm* — Cantor Colburn LLP

(57) ABSTRACT

A cooling panel for a metallurgical furnace includes a body with a front face and an opposite rear face, a top face and an opposite bottom face and two opposite side faces. The body has at least one cooling channel therein, the cooling channel having openings in the rear face; wherein, in use, the front face of the body is turned towards a furnace interior. According to the invention, the cooling panel having at least one cooling pipe arranged in at least one elongate recess formed in the front face, where the cooling pipe has an elongate middle section and at either end thereof, an angled branch, the cooling pipe forming the cooling channel, and
(Continued)

where the cooling pipe is arranged in the elongate recess such that the angled branches protrude through the openings in the rear face of the body.

12 Claims, 9 Drawing Sheets

(51) Int. Cl.
*F27D 1/12* (2006.01)
*F27D 9/00* (2006.01)

(52) U.S. Cl.
CPC ..... *F27D 2009/0021* (2013.01); *F27D 2009/0043* (2013.01); *F27D 2009/0048* (2013.01)

(58) Field of Classification Search
USPC ..... 266/44, 190, 193, 194; 29/428, 890.03; 165/170
See application file for complete search history.

(56) References Cited

U.S. PATENT DOCUMENTS

| | | | | |
|---|---|---|---|---|
| 7,549,463 | B1 * | 6/2009 | Schmeler | F28F 3/12 165/168 |
| 2011/0210484 | A1 * | 9/2011 | Lonardi | F27D 9/00 266/241 |

FOREIGN PATENT DOCUMENTS

| | | | |
|---|---|---|---|
| TW | 201040284 | A | 11/2010 |
| WO | 03067154 | A1 | 8/2003 |
| WO | 2010076368 | A1 | 7/2010 |
| WO | 2015144985 | A1 | 10/2015 |

OTHER PUBLICATIONS

Written Opinion dated Apr. 9, 2018 re: Application No. PCT/EP2018/054285, pp. 1-5, citing: WO 2010/076368 A1, W 03/067154 A1 and WO 2015/144985 A1.
Search Report dated May 27, 2021, re: Application 107105792, pp. 1.

* cited by examiner

COOLING PANEL FOR METALLURGICAL FURNACE

TECHNICAL FIELD

The present disclosure generally relates to cooling panels for metallurgical furnaces such as e.g. blast furnaces, and in particular to cooling panels with means for repairing damaged cooling panels.

BACKGROUND

Cooling panels for metallurgical furnaces, also called "staves", are well known in the art. They are used to cover the inner wall of the outer shell of the metallurgical furnace, as e.g. a blast furnace or electric arc furnace, to provide a heat evacuating protection screen between the interior of the furnace and the outer furnace shell. They generally further provide an anchoring means for a refractory brick lining, a refractory guniting or a process generated accretion layer inside the furnace.

Originally, the cooling panels have been cast iron plates with cooling channels cast therein. As an alternative to cast iron staves, copper staves have been developed. Nowadays, most cooling panels for a metallurgical furnace are made of copper, a copper alloy or, more recently, of steel.

The refractory brick lining, the refractory guniting material or the process generated accretion layer forms a protective layer arranged in front of the hot face of the panel-like body. This protecting layer is useful in protecting the cooling panel from deterioration caused by the harsh environment reigning inside the furnace. In practice, the furnace is however also operated without this protective layer, resulting in erosion of the lamellar ribs of the hot face.

As it is known in the art, while the blast furnace is initially provided with a refractory brick lining on the front side of the staves or steel blades inserted in the grooves of the staves, this lining wears out during the campaign. In particular, it has been observed that, in the bosh section, the refractory lining may disappear relatively rapidly.

As the cooling panels are worn, mainly by abrasion, the coolant circulating through the cooling channel may leak into the furnace or blast furnace gas may enter the cooling circuit. Such leaks are of course to be avoided.

When such a leak is detected, the first reaction will generally be to stop feeding coolant to the leaking cooling channel until the next programmed stoppage, during which a flexible hose can be fed through the cooling channel, such as e.g. described in JP2015187288A. Subsequently, the flexible hose is connected to coolant feed and coolant may be fed through the flexible hose within the cooling panel. Thus, the metallurgical furnace can be operated further without having to replace the damaged cooling panel.

However, once the coolant feed through the leaking cooling channel is interrupted, material from the furnace may enter the cooling channel thereby hindering a subsequent installation of the flexible hose.

A severely worn cooling panel leads to a temperature increase of the copper surrounding the channel, which leads to a loss of copper mechanical properties. In some cases, this may lead to a complete destruction of the cooling plate, which leaves the furnace shell directly exposed to high heat loads and to abrasion.

Also, the installation of the flexible hose into the cooling channel is rather complicated. The flexible hose needs to have smaller diameter than the cooling channel and have a rather thin wall thickness to be manipulated in the angles/corners of the cooling channel. Such a thin wall thickness of the flexible hose does not survive for a long time against abrasion. Thus, the flexible hose only allows prolonging the lifetime of the cooling panel for a short period of time.

BRIEF SUMMARY

The aim of the present disclosure is to provide an improved cooling panel, which provides quick and effective repair in case of leaking coolant. A further aim of the present disclosure is to provide a cooling panel that can be produced faster and with reduced cost.

The present disclosure concerns a cooling panel for a metallurgical furnace comprising a body with a front face and an opposite rear face, a top face and an opposite bottom face and two opposite side faces. The body has at least one cooling channel therein, the cooling channel having openings in the rear face. In use, the front face of the body is turned towards a furnace interior.

According to the present disclosure, the cooling panel comprises at least one cooling pipe having an elongate middle section and, at either end thereof, an angled branch, the at least one cooling pipe forming the cooling channel.

The cooling panel further comprises at least one elongate recess formed in the front face of the body, the at least one cooling pipe being arranged in the at least one elongate recess such that the angled branches protrude through the openings in the rear face of the body.

By installing a cooling pipe in a recess formed in the front face of the cooling panel, such a cooling pipe can be quickly installed, which is of particular interest when a damaged cooling pipe is to be replaced. Indeed, the damaged cooling pipe can be removed from the recess and a new, undamaged cooling pipe can be installed such that the cooling panel is available for further use.

It should be noted that the cooling pipe of the present disclosure can also be used to repair a damaged cooling channel of a traditional cooling panel, i.e. a cooling panel that has not been initially conceived to receive such a cooling pipe. Generally, if a traditional cooling panel is damaged, a flexible hose may be passed through the damaged cooling channel in order to attempt to create a coolant passage within the cooling channel. The installation of such a flexible hose is however rather delicate and time consuming. Instead of installing such a flexible hose, it is suggested to form an elongate recess in the front face of the cooling panel and then installing a cooling pipe according to the disclosure in the newly formed recess.

The fact that the cooling pipe comprises a middle section and, at either end thereof, an angled branch, is also of particular interest. Indeed, the angled branches of the cooling pipe are formed and arranged so as to protrude out of the rear face of the cooling panel when the cooling pipe is arranged in the body of the cooling panel. These protruding angled branches act as coolant feed pipes that would in prior art solutions been welded onto the rear face of the cooling panel. However, such welding is rather time consuming and thus renders the manufacturing of the cooling panel rather expensive. By providing a cooling pipe with integral feed pipes, such welding is no longer required, thus speeding up the manufacturing process and saving costs.

Also, the manufacturing of traditional cooling panels requires the forming of a cooling channel in the body, the subsequent forming and shaping of the panel and finally the welding of the feed pipes. With the present disclosure, the forming and shaping of the body of the cooling panel after installation of the cooling pipe is not required, thus again saving on manufacturing time and cost.

Advantageously, the cooling pipe has a front face with a profile which, when arranged in the body, matches the profile of the front face of the body. Indeed, the front face of the body may have a structured surface with alternating ribs and grooves. In which case, the front face of the cooling pipe preferably has a matching structured surface with alternating ribs and grooves. Cooling panels indeed generally comprise alternating ribs and grooves on their front face. As the cooling pipe is arranged in a recess in the front face of the body of the cooling plate, a front face of the cooling pipe with a matching structured surface allows for the cooling panel to have the typical general rib and groove structure.

The front face of the cooling pipe is preferably integrally formed with the cooling pipe. This not only warrants a safe and robust structure, but also allows for a good heat transfer between the front face of the cooling pipe and the coolant passing through the cooling pipe.

The cooling pipe and front face may be formed by extrusion, machining, casting or 3D-printing. The 3D-printing in particular allows forming complex shapes.

The middle section of the cooling pipe may have round, oblong or rectangular cross-section, depending on the shape of the recess in the body of the cooling panel.

Advantageously, the elongate recess and the cooling pipe are formed so as to provide a self-locking arrangement, in order to securely maintain the cooling pipe within the elongate recess and to ensure proper conduction heat transfer between the cooling pipe and the body of the cooling panel.

The elongate recess may comprise a protrusion, while the cooling pipe may comprise a channel for receiving the protrusion therein. Alternatively, of course, the cooling pipe may comprise the protrusion, while the elongate recess comprises the channel. The protrusion and channel may be local or extend over the whole length of the cooling pipe. In order to install the cooling pipe in the elongate recess and engage the protrusion in the recess, the cooling pipe may be forced into the elongate recess with sufficient force to force the protrusion into the channel. Alternatively, the body of the cooling panel may be heated up so that it expands, thereby allowing the protrusion to be arranged in the channel. As the cooling panel subsequently cools down, the cooling panel shrinks and the protrusion is safely arranged in the channel.

At least one of the ribs of the body and at least one of the ribs of the cooling pipe may be provided with cooperating through holes, wherein the through holes are in alignment when the cooling pipe is arranged within the elongate recess. A bolt may then be arranged through the through holes. Such a bolt allows to secure the cooling pipe within the elongate recess.

Preferably, the bolt comprises threaded shaft ends and nuts are provided for cooperating with the shaft ends. The tightening of such nuts allows tightly securing the cooling pipe within the elongate recess. This not only prevents the cooling pipe from falling out of the elongate recess, but forces the side walls of the elongate recess to tightly push against the cooling pipe, thereby also improving the heat transfer between the cooling pipe and the body of the cooling panel.

According to preferred embodiments, the at least one elongate recess is formed in the front face in a direction essentially parallel to the side faces of the body of the cooling panel. If the front face of the body has a structured profile with alternating ribs and grooves, such ribs and grooves are generally arranged in a direction perpendicular to the side faces of the body. Thus, the front face of the cooling pipe should have a profile matching that of the front face of the body; i.e. it should have ribs and grooves.

According to another embodiment, the at least one elongate recess is formed in the front face in a direction essentially perpendicular to the side faces of the body of the cooling panel. In this case, the elongate recess would be parallel to the ribs and grooves in the front face of the body. Thus, the shaping of the front face of the cooling pipe can be considerable simplified. Preferably, the elongate recess may be entirely formed within the ribs of the front face of the body.

BRIEF DESCRIPTION OF THE DRAWINGS

Further details and advantages of the present disclosure will be apparent from the following detailed description of several not limiting embodiments with reference to the attached drawings, wherein.

DETAILED DESCRIPTION

Figure 1:
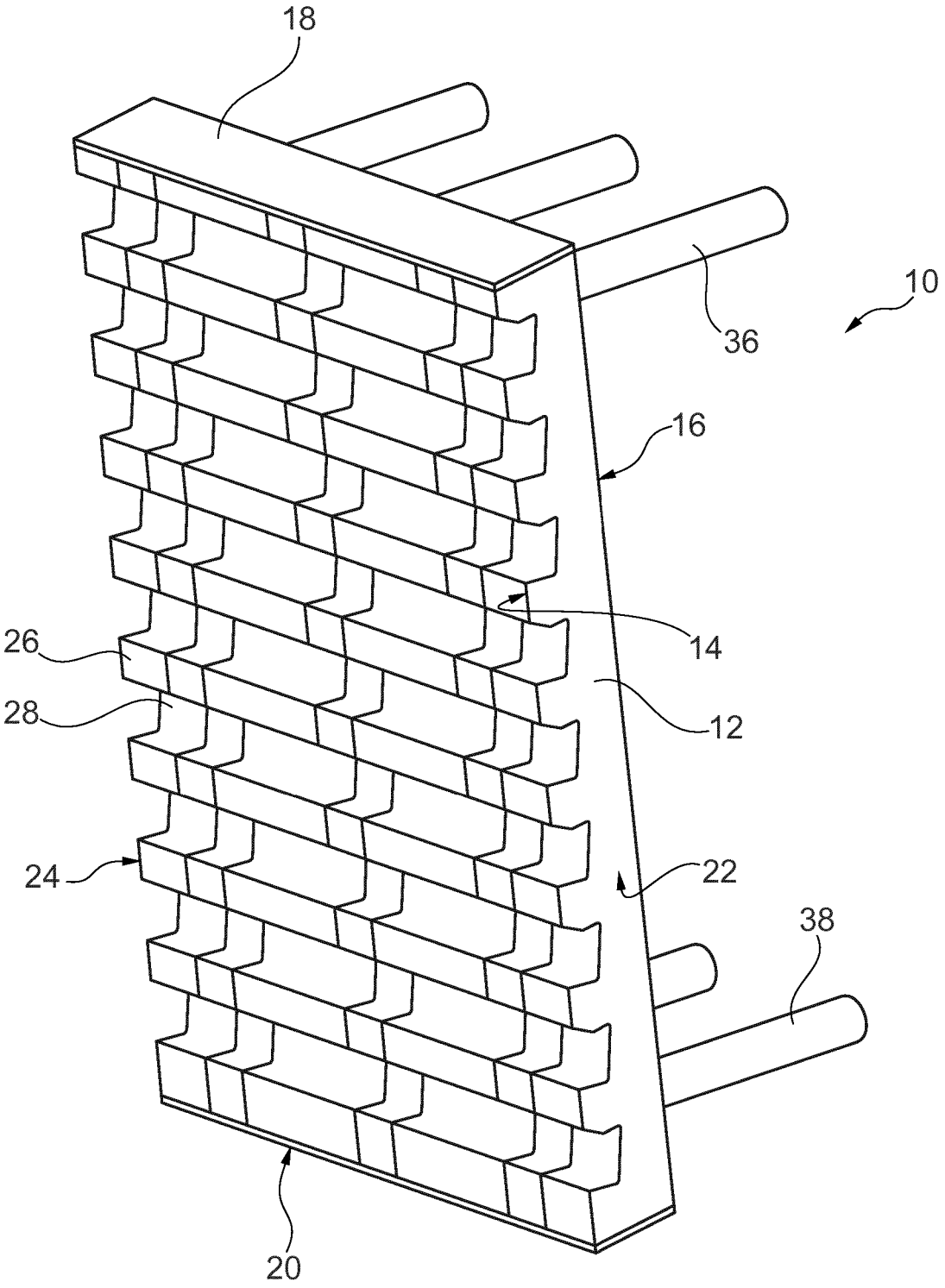
FIG. 1 is a perspective view of a cooling panel according to a first embodiment of the present disclosure.

FIG. 1 schematically shows a cooling panel 10 according to a first embodiment of the disclosure, wherein the cooling panel 10 comprises a body 12 typically formed from a slab e.g. made of a cast or forged body of copper, copper alloy, cast iron, steel or a hybrid combination of these materials. The body 12 has a front face 14 (often referred to as hot face) for facing the interior of a metallurgical furnace and an opposite rear face 16 (often referred to as cold face) for facing the furnace shell. The essentially rectangular body 12 of the cooling panel 10 has a top face 18 and an opposite bottom face 20 and two opposite side faces 22, 24. At least one cooling channel is arranged within the body 12 for feeding coolant therethrough. The body 12 has openings in the rear face 16 corresponding to the inlet and outlet ends of the cooling channel.

As is known in the art, the front face 14 of body 12 advantageously has a structured surface, in particular with alternating ribs 26 and grooves 28. When the cooling panel 10 is mounted in the furnace, the grooves 28 and lamellar ribs 26 are generally arranged horizontally to provide an anchoring means for a refractory brick lining (not shown).

Figure 2:
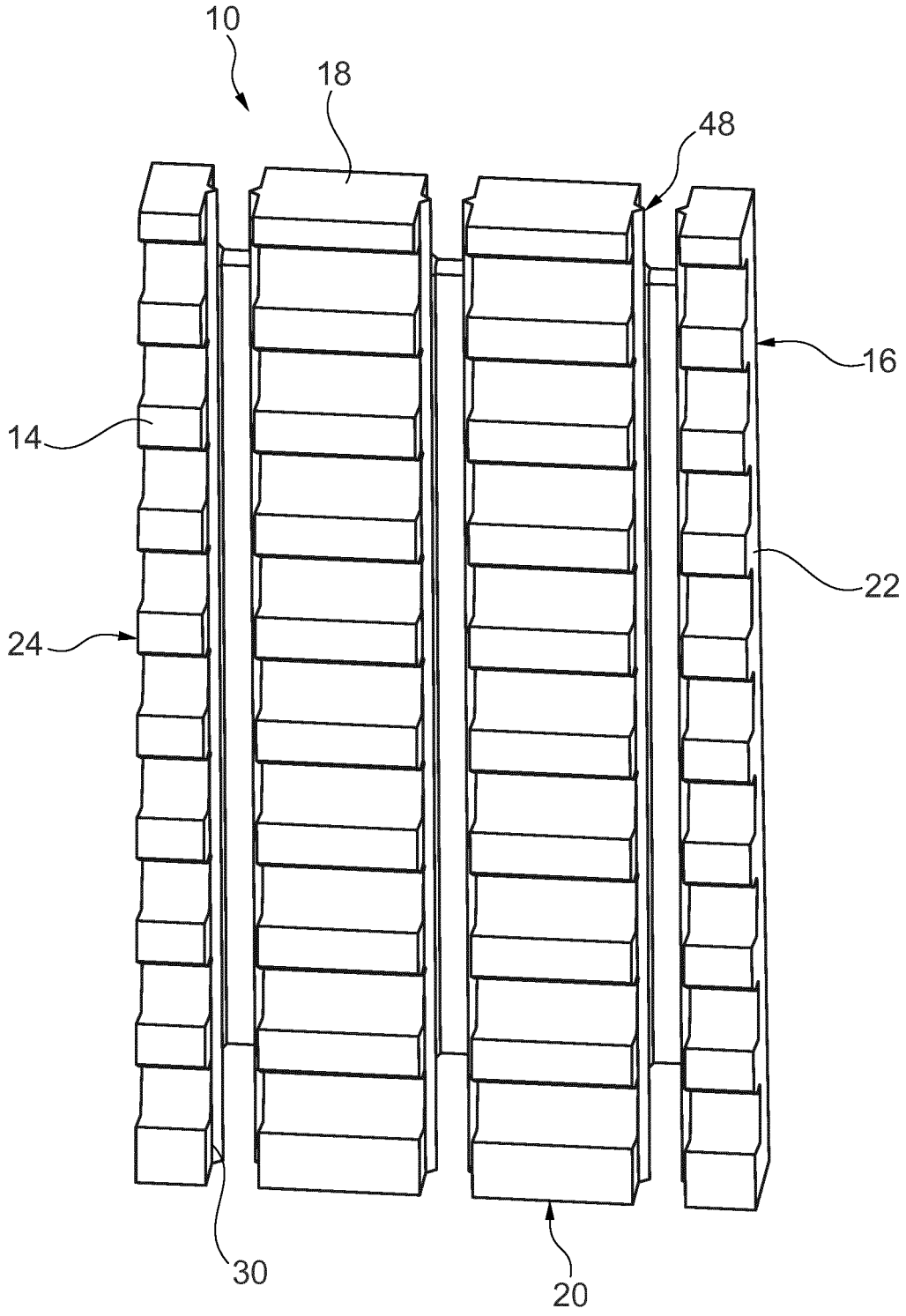
FIG. 2 is a perspective view of a body of the cooling panel of FIG. 1.

The cooling panel 10 comprises an elongate recess 30 (better seen in FIG. 2) in its front face 14. Such an elongate recess 30 may, as shown in FIG. 2, extend from the top face 18 to the bottom face 20.

Figure 3:
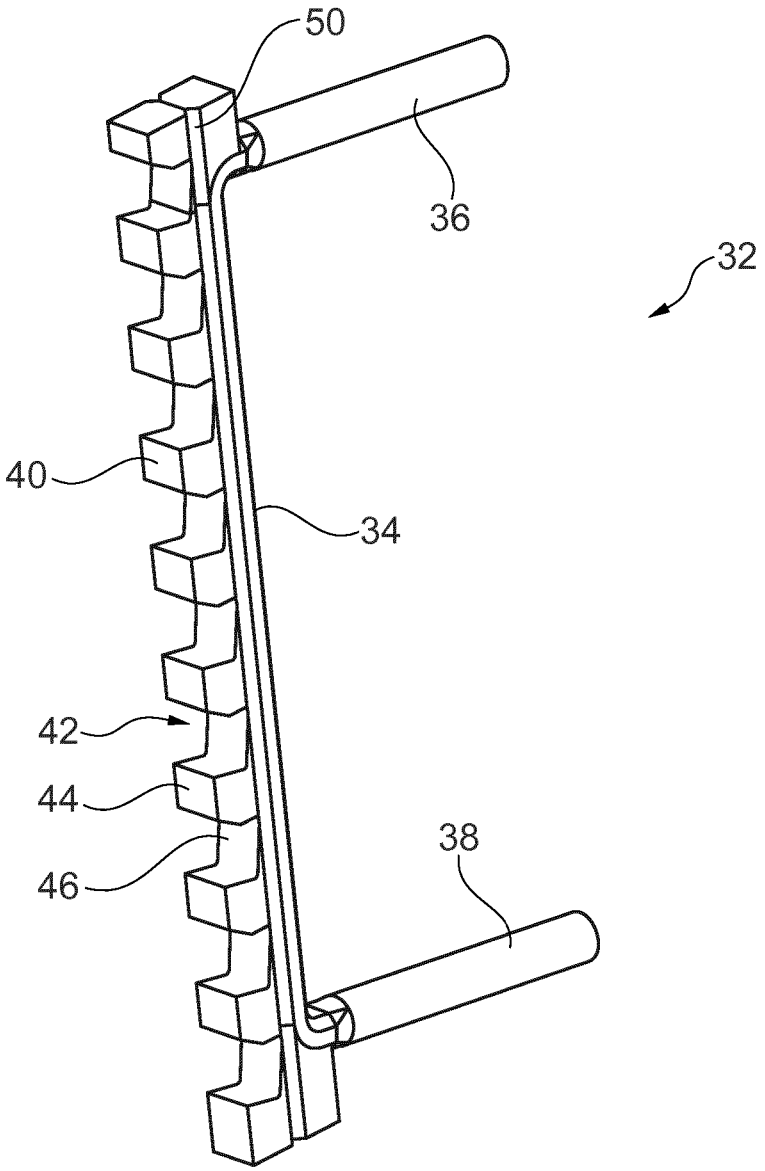
FIG. 3 is a perspective view of a cooling pipe of the cooling panel of FIG. 1.

The cooling panel 10 further comprises a cooling pipe 32 as shown in FIG. 3. Such a cooling pipe 32 has an elongate middle section 34 and at either end thereof, an angled branch 36, 38. The cooling pipe 32 is dimensioned so as to snuggly fit inside an elongate recess 30 in the body 12, while the angled branches 36, 38 protrude from the rear face 16 of the body 12. The middle section 34 of the cooling pipe 34 forms the cooling channel within the body 12, while the angled branches 36, 38 form the coolant feed pipes.

The cooling pipe 32 further has a front face 40 with a structured surface with cut-out sections 42 forming alternating ribs 44 and grooves 46. The ribs 44 and grooves 46 of the front face 40 of the cooling pipe 32 are formed such that, when the cooling pipe 32 is arranged in the elongate recess 30 of the body 12, they match the ribs 26 and grooves 28 of the front face 14 of the body 12.

The cooling pipe 32 has a shape that is complementary to the elongate recess 30 formed in the front face 14 of the body 12.

In order to maintain the cooling pipe 32 in the elongate recess 30, the elongate recess 30 is provided with a protrusion 48 which cooperates with a channel 50 arranged in a lateral portion of the cooling pipe 32 thus providing a self-locking construction.

Once the cooling pipe 32 is arranged in the elongate recess 30, the cooling pipe is securely maintained in place by the protrusion 48 and channel 50 arrangement. As the cooling pipe 32 has a shape complementary to the elongate recess 30, the cooling pipe 32 and body 12 form the cooling panel 10 and heat transfer between the front face 14 of the cooling panel 10 and the coolant circulating in the cooling pipe 32 is maintained.

Typical cooling panels 10 comprise a plurality of cooling channels in order to provide a heat evacuating protection screen between the interior of the furnace and the outer furnace shell. In the embodiment shown in FIGS. 1 to 3, a cooling panel 10 is provided with three such cooling channels. In other words, the body 12 comprises three elongate recesses 30 and three cooling pipes 32 arranged therein.

During operation of a blast furnace or similar, the refractory brick lining erodes due to the descending burden material, causing the cooling panels to be unprotected and exposed to the harsh environment inside the blast furnace.

The front face 14 of body 12 may be provided with means for protecting the cooling panel against abrasion. One example of such means may be metal inserts (not shown) arranged in the grooves 28, 46.

However, as the cooling panel 10 is exposed to the harsh environment inside the blast furnace, abrasion of the cooling panel 10 and the cooling pipe 32 occurs. If the cooling pipe 32 is damaged, coolant from the cooling pipe 32 can leak into the furnace. In this case, the damaged cooling pipe 32 is removed and replaced with a new, undamaged cooling pipe 32.

It should be noted that the cooling pipe 32 of the present disclosure can also be used to repair a damaged cooling channel of a traditional cooling panel. A cooling channel within the body of such a traditional cooling panel is generally obtained by any known means, such as e.g. casting or drilling. A feed pipe is attached to the rear face of the cooling panel by welding and coolant is fed through the cooling channel. The coolant is in direct contact with the material of the body of the cooling panel. If the cooling panel is, in operation, damaged such that abrasion or a crack is formed between the cooling channel and the front face of the cooling panel, coolant from the cooling channel can leak into the furnace. In order to repair such a cooling panel, an elongate recess may be cut into the front face of the cooling panel. A cooling pipe 32 according to the present disclosure may then be installed in the elongate recess and the cooling panel may be used again.

Figure 4:
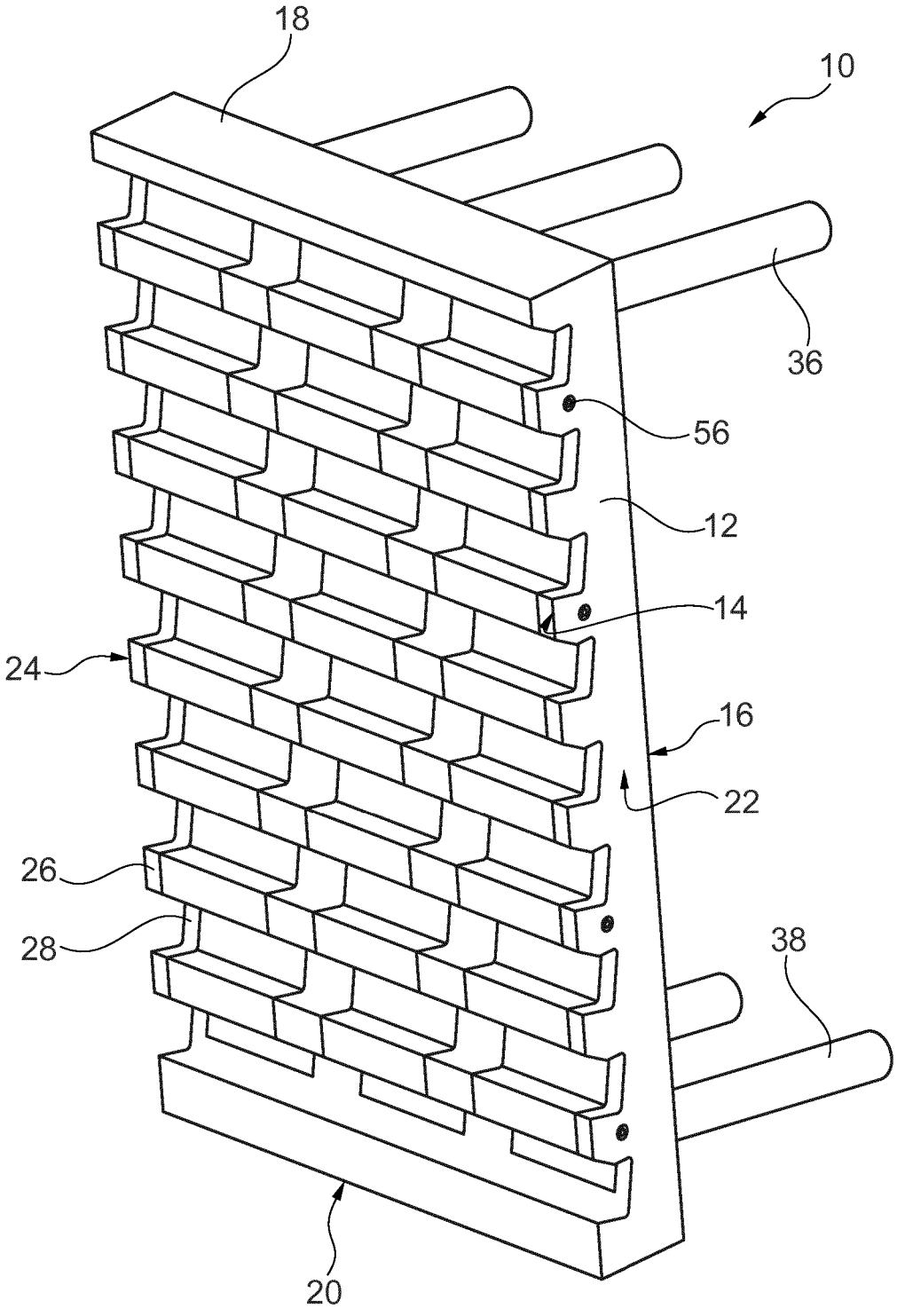
FIG. 4 is a perspective view of a cooling panel according to a second embodiment of the present disclosure.
Figure 5:
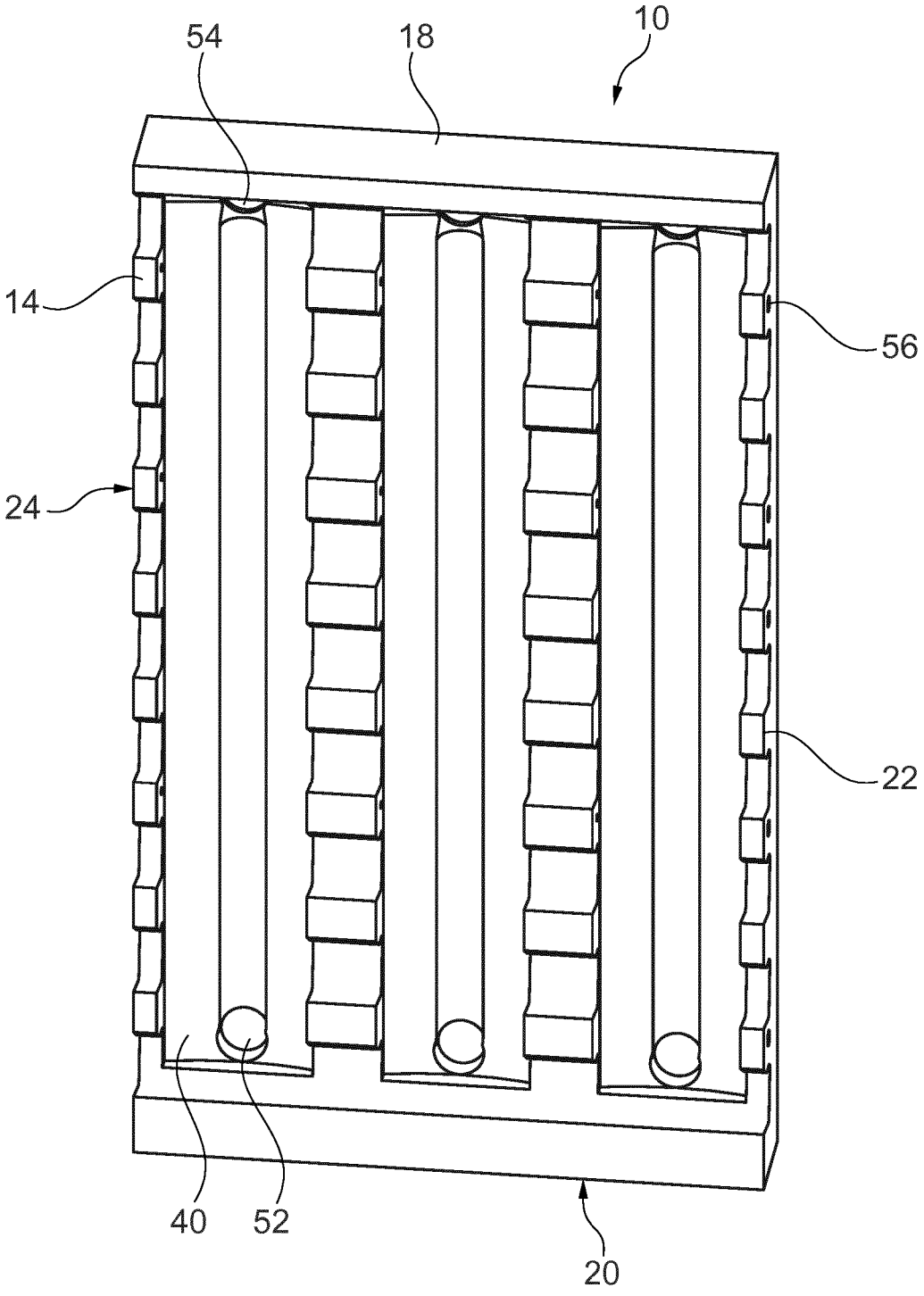
FIG. 5 is a perspective view of a body of the cooling panel of FIG. 4.
Figure 6:
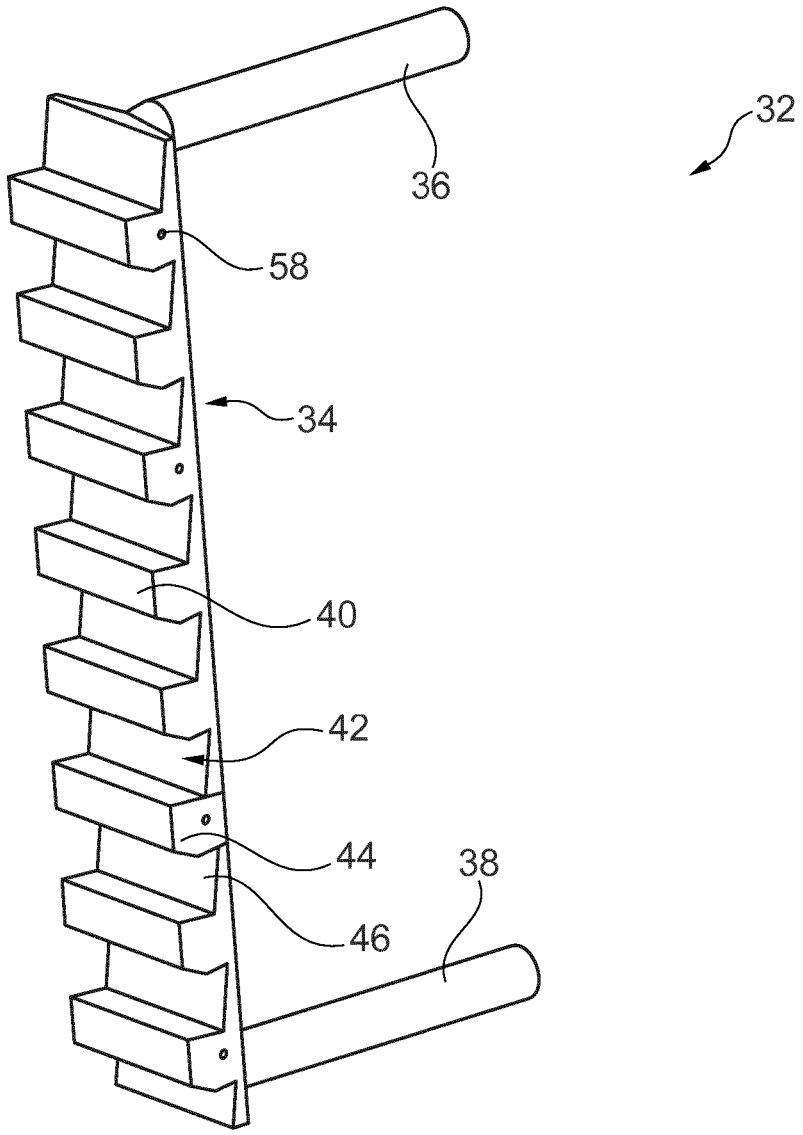
FIG. 6 is a perspective view of a cooling pipe of the cooling panel of FIG. 4.

FIGS. 4, 5 and 6 schematically show a cooling panel 10 according to a second embodiment of the disclosure. As many of the features of this second embodiment are identical with the ones of the first embodiment they will not be repeated here. Mainly the differences are highlighted. As seen in FIG. 6, the cooling pipe 32 has a front face 40 which is considerably wider than the cross-section of the middle section 34 it is connected to. Again, the elongate recess 30 in the front face 14 of the body 12 is shaped so as to be complementary to the shape of the cooling pipe 32 such that the cooling pipe 32 snuggly fits therein. FIG. 5 also shows the openings 52, 54 in the rear face 16 of the body 12, through which the angled branches 36, 38 are fed.

Figure 7:
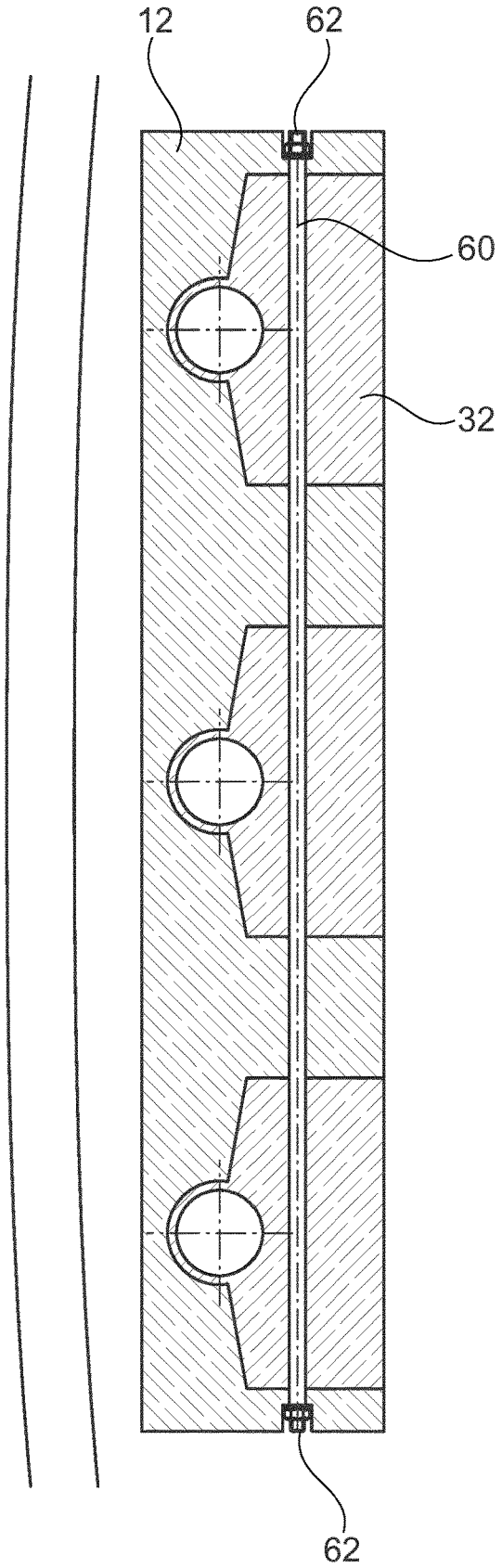
FIG. 7 is a cross-section view across the cooling panel of FIG. 4.

In order to secure the cooling pipe 32 in the elongate recess 30, some of the ribs 26 of the body 12 and some of the ribs 44 of the cooling pipe 32 are provided with cooperating through holes 56, 58. When the cooling pipe 32 is correctly arranged within the elongate recess 30, the through holes 56, 58 are in alignment and a bolt 60 is passed therethrough. FIG. 7 is a cross-section view across the cooling panel 10 of FIG. 4 and shows three cooling pipes 32 arranged in three elongate recesses 40. FIG. 7 also shows the shaft 60 passing across the ribs 26, 44 of both the body 12 and the cooling pipe 32. At each end of the shaft 60, a nut 62 may be arranged for cooperating with a threaded end of the bolt 60. By tightening the nuts 62, the connection between the body 12 and the cooling pipe 32 can be made stronger. This not only ensures that the cooling pipe 32 remains in place, but also improves the heat transfer between the cooling pipe 32 and the body 12.

Figure 8:
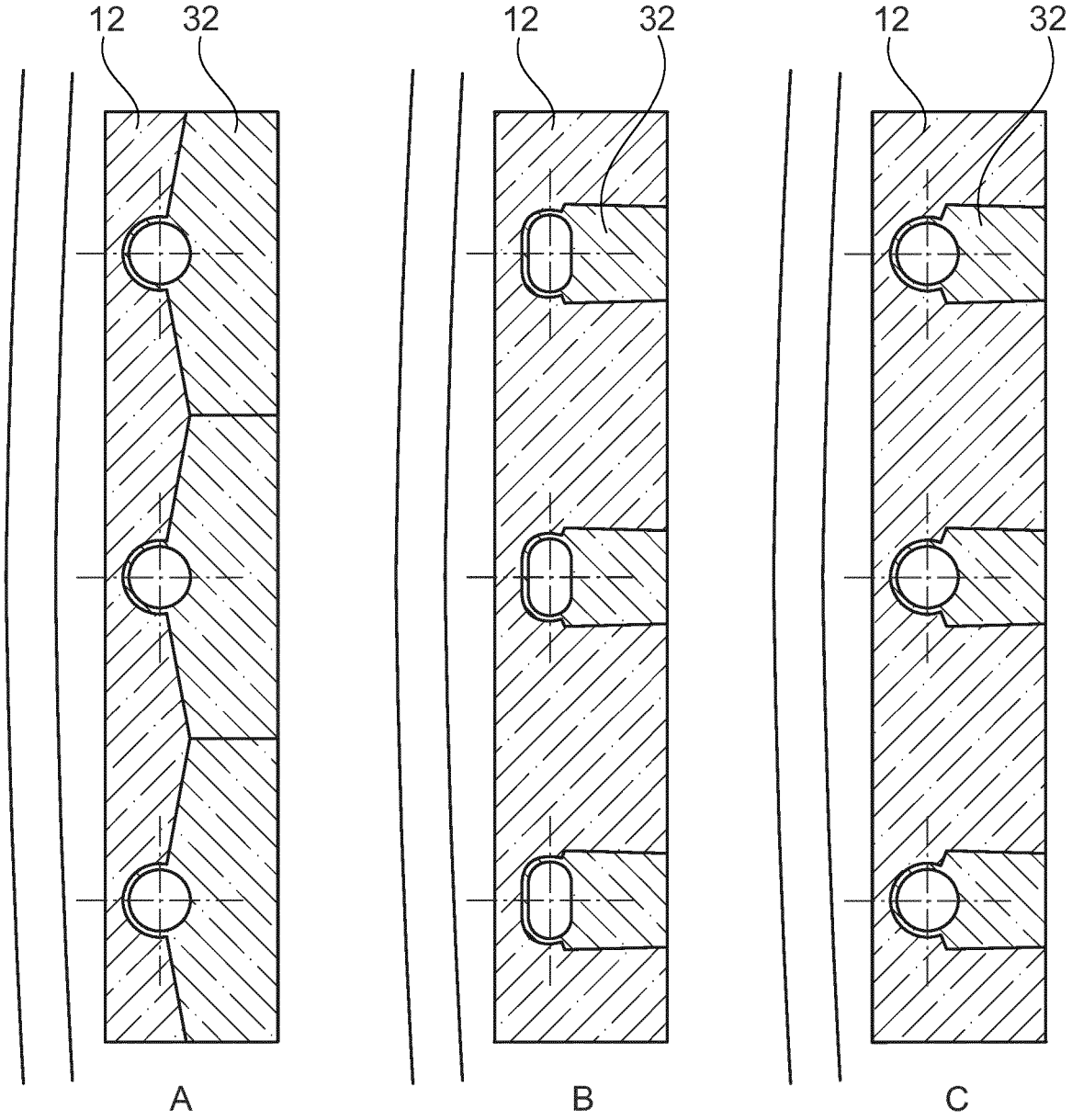
FIG. 8 is a series of cross-sections across cooling panels according to further embodiments

FIG. 8 shows further embodiments of the cooling panel 10 to illustrate further designs. The middle section 34 of the cooling pipe 32 may e.g. have round cross-section as shown in A and C or oblong cross-section as shown in B. In fact, any cross-section that can be obtained by forging, casting or 3D-printing may be envisaged.

The front face 40 of the cooling pipe 32 may be of various shape and/or width. In A, the front face 40 has a width such that the front faces of neighboring cooling pipes 32 come into contact with each other such that the front face of the body 12 becomes obsolete. In B and C, on the other hand, the front face 40 of the cooling pipe 32 has a width barely exceeding the cross-section of the middle section 34. It should be noted that these are variations that may be applied to both the first and second embodiments described above.

The body 12 of the cooling panel 10 may be made of copper, steel, cast iron or any alloy based thereon. Similarly, the cooling pipe 32 may be made of copper, steel, cast iron or any alloy based thereon.

Figure 9:
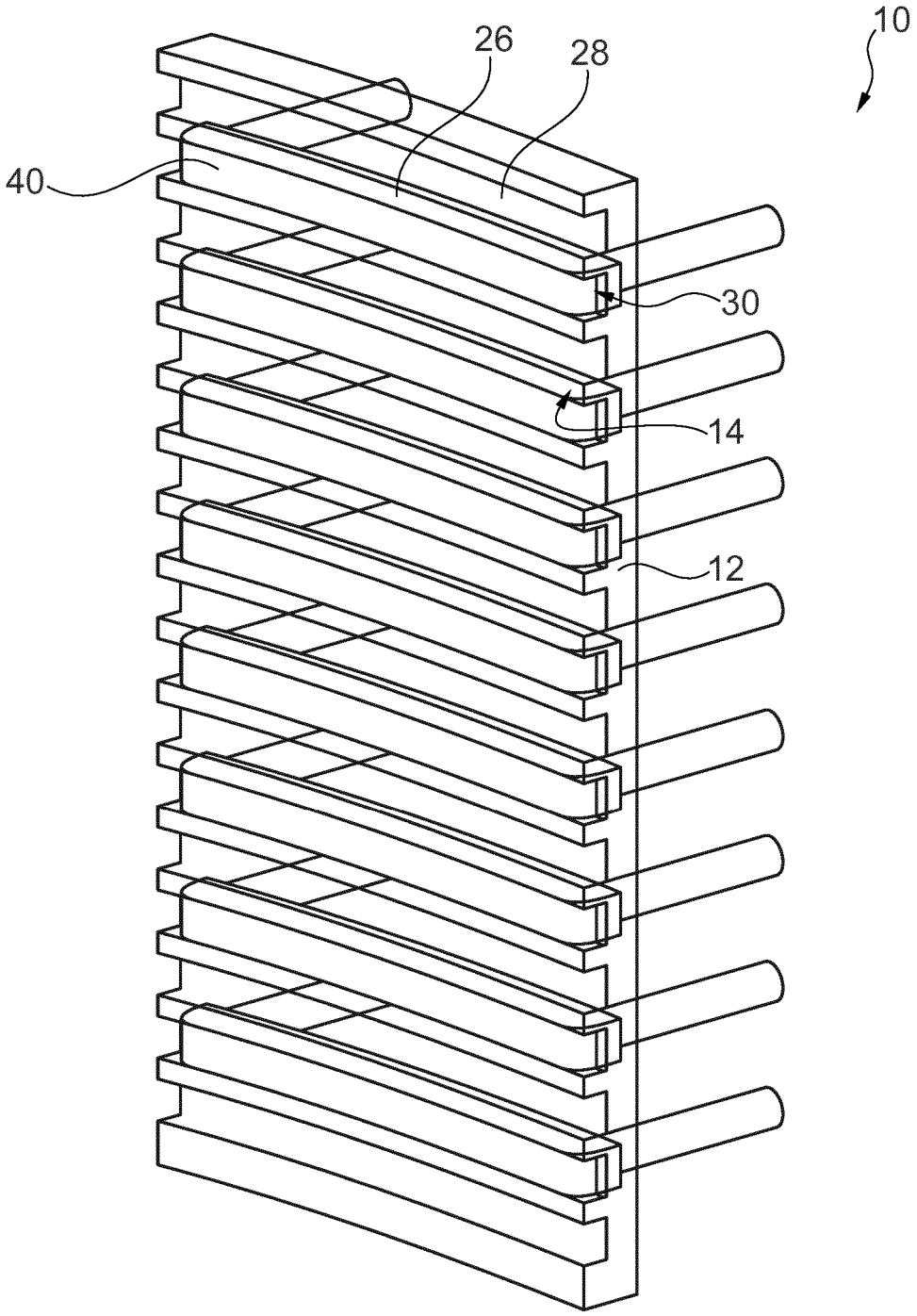
FIG. 9 is a perspective view of a cooling panel according to a further embodiment of the present disclosure.

A further embodiment of the disclosure is shown in FIG. 9, wherein the elongate recess 30 is arranged in a direction parallel to the ribs and grooves 26, 28 of the front face 14 of the body 12 of the cooling panel 10. The elongate recess 30 may be entirely arranged within the rib 26; preferably the elongate recess 30 extends over the whole length of the rib 26, i.e. from one side face 22 to the other 24. The front face 40 of the cooling pipe 32 is formed so as to completely fill the elongate recess 30, then the cooling pipe 32 is installed therein, such that the front face 40 of the cooling pipe 32 is flush with the rib 26.

The invention claimed is:

1. A cooling panel for a metallurgical furnace comprising a body with a front face and an opposite rear face, a top face and an opposite bottom face and two opposite side faces, said body having at least one cooling channel therein, said cooling channel having openings in said rear face; wherein, in use, said front face of said body is turned towards a furnace interior, at least one cooling pipe having an elongate middle section and at either end thereof, an angled branch, said at least one cooling pipe defining said cooling channel, wherein said body comprises at least one elongate recess formed in said front face, said at least one cooling pipe being arranged in said at least one elongate recess such that said angled branches protrude through said openings in said rear face of said body.

2. The cooling panel according to claim 1, wherein said at least one cooling pipe has a front face with a profile which, when arranged in said body, matches a profile of said front face of said body.

3. The cooling panel according to claim 2, wherein said front face of said body has a structured surface with alternating ribs and grooves and wherein said front face of said at least one cooling pipe has a matching structured surface with alternating ribs and grooves.

4. The cooling panel according to claim 1, wherein said front face of said at least one cooling pipe is integrally formed with said at least one cooling pipe.

5. The cooling panel according to claim 4, wherein said at least one cooling pipe and front face are formed by extrusion, machining, casting or 3D-printing.

6. The cooling panel according to claim 1, wherein said middle section of said at least one cooling pipe has round, oblong or rectangular cross-section.

7. The cooling panel according to claim 1, wherein said at least one elongate recess and said at least one cooling pipe are formed so as to provide a self-locking arrangement.

8. The cooling panel according to claim 7, wherein one of said at least one elongate recess and said at least one cooling pipe comprises a protrusion and wherein the other of said at least one elongate recess and said at least one cooling pipe comprises a channel for receiving said protrusion therein.

9. The cooling panel according to claim 3, wherein at least one of said ribs of said body and at least one of said ribs of said at least one cooling pipe is provided with cooperating through holes, wherein said through holes are in alignment when said at least one cooling pipe is arranged within said at least one elongate recess, and wherein a bolt is arranged through said through holes.

10. The cooling panel according to claim 9, wherein said bolt comprises threaded shaft ends and wherein nuts are provided for cooperating with said shaft ends.

11. The cooling panel according to claim 1, wherein said at least one elongate recess formed in said front face is in a direction essentially parallel to said side faces of said body.

12. The cooling panel according to claim 1, wherein said at least one elongate recess formed in said front face is in a direction essentially perpendicular to said side faces of said body.

* * * * *